United States Patent [19]

Dysart

[11] Patent Number: 4,981,182

[45] Date of Patent: Jan. 1, 1991

[54] SEALED ROTARY BLAST HOLE DRILL BIT UTILIZING AIR PRESSURE FOR SEAL PROTECTION

[75] Inventor: Theodore R. Dysart, Dallas, Tex.

[73] Assignee: Dresser Industries, Inc., Dallas, Tex.

[21] Appl. No.: 471,085

[22] Filed: Jan. 26, 1990

[51] Int. Cl.[5] ..... E21B 10/18; E21B 10/24

[52] U.S. Cl. ..... 175/71; 175/227; 175/337; 175/339; 175/371

[58] Field of Search ..... 175/337, 339, 371, 372, 175/228, 227, 313, 71; 384/93, 94; 277/59, 74, 17

[56] References Cited

U.S. PATENT DOCUMENTS

| | | | |
|---|---|---|---|
| 3,125,175 | 3/1964 | Medlock et al. | 175/337 |
| 3,921,735 | 11/1975 | Dysart | 175/337 |
| 4,092,054 | 5/1978 | Dye | 175/337 X |
| 4,098,358 | 7/1978 | Klima | 175/65 |
| 4,102,419 | 7/1978 | Klima | 175/371 |
| 4,183,417 | 1/1980 | Levefelt | 175/339 |
| 4,225,144 | 9/1980 | Zitz et al. | 175/372 X |
| 4,272,134 | 6/1981 | Levefelt | 308/8.2 |
| 4,298,079 | 11/1981 | Norlander et al. | 175/372 X |
| 4,375,242 | 3/1983 | Galle | 175/371 X |
| 4,386,668 | 6/1983 | Parish | 175/228 |
| 4,421,184 | 11/1983 | Mullins | 175/337 |
| 4,453,836 | 6/1984 | Klima | 175/371 |
| 4,515,228 | 5/1985 | Dolezal et al. | 175/339 X |
| 4,552,233 | 11/1985 | Klima | 175/371 |
| 4,610,319 | 9/1986 | Kalsi | 175/371 |
| 4,688,651 | 8/1987 | Dysart | 175/371 |

FOREIGN PATENT DOCUMENTS 2019921 11/1979 United Kingdom .

*Primary Examiner*—Hoang C. Dang

[57] ABSTRACT

A sealed rotary drill bit has a plurality of leg members, with each leg member having a projecting conical cutter receiving journal. A conical cutter has friction reducing bearings interior to the conical cutter for rotatably mounting the cutter on the respective journal. A sealing arrangement retains lubricant for the bearings. A circumferential porous gas restrictor is positioned concentric with and spaced outwardly from the sealing arrangement to form an annular gas chamber therebetween. Pressurized gas is carried by passageways into the annular gas chamber. The porous gas restrictor, which can be formed of metal particles bonded together, prevents drilling debris from getting past it, but the porosity of the restrictor allows pressurized gas to pass therethrough as a controlled dissipation and wash away drilling debris, thereby shielding the sealing arrangement from debris that might otherwise reach the sealing arrangement. The sealing arrangement can include an inner seal and an outer seal positioned concentric to each other with the circumferential seal gap therebetween filled with lubricant.

32 Claims, 3 Drawing Sheets

SEALED ROTARY BLAST HOLE DRILL BIT UTILIZING AIR PRESSURE FOR SEAL PROTECTION

TECHNICAL FIELD OF THE INVENTION

This invention relates to sealed rotary drill bits. In a specific aspect the invention relates to sealed rotary drill bits which can be used in blast hole drilling, and in particular to sealed rotary drill bits utilizing air pressure for seal protection.

BACKGROUND OF THE INVENTION

One function of rotary drill bits is use in blast hole drilling. In general, blast holes have a depth in the range of about 50 to about 150 feet and are filled with a blasting material for breaking up the earth during mining operations. The body of the drill bit typically used for drilling blast holes is attached to a drill pipe by a threaded member on the body of the bit. The drill pipe is supported and rotated by a drilling rig. The body of the drill bit typically has three legs, each of the legs having a projecting, conical cutter-receiving journal. Three conical cutters, each having an axially extending recess open at one end, are rotatably mounted on respective journals with the use of friction reducing bearings interior to the conical cutters. Each conical cutter has rock cutting teeth or inserts on the surface of the conical cutter. The conical cutters cut through the earth when the weight of the drill pipe above the drill bit and the rotation of the drill pipe causes the conical cutters to independently rotate about their individual journals and cut through the earth.

Unlike oil field drilling where the drill bit will generally be cutting in the presence of liquid drilling mud, the blast hole drilling environment is dry and abrasive. In order to reduce interior wear of the oil field drill bit, fluid carrying conduits interior to the leg members and extending to the bearings inside the conical cutters supply lubrication to the bearings. In order to prevent loss of lubricant, typically each conical cutter of the oil field drill bits will have some sort of sealing means to retain the lubricant. The sealing means, which is located at the open end of the conical cutter recess, also prevents abrasive materials from entering through any space between the leg of the drill and the open end of the conical cutter mounted on the journal to the inside of the conical cutter to the bearings. However, since in blast hole drilling the environment is much more abrasive, the lubricating system and sealing means of an oil field drill bit are not used in many blast hole drill bits because the abrasive environment will quickly erode the seals, causing lubricant loss and drill bit failure.

Instead of supplying lubrication to the bearings to reduce wear, many drill bits circulate air through the bearings to cool the bearings and to wash away abrasive debris. For example, U.S. Pat. No. 3,921,735, by Dysart, discloses a passageway that extends through a bit body for conducting a gaseous drilling fluid to cool and clean the bearings. A cone mouth air screen is provided to screen out drilling debris. The screen material is selected so that its porous area is such that it will allow passage of all the air needed to cool and clean the bearings with a minimum of back pressure, but still fit satisfactorily into the minimal available space at the constricted cone mouth of a typical cone arm sub-assembly for a three cutter blast hole bit.

Sealing in lubricant is an effective way of lubricating the bearings and extending the life of the drill bit. There are attempts at providing sealed in lubricant for blast hole bits with means for protecting the seal from erosion from the abrasive blast hoe environment. U.S. Pat. No. 4,183,417, by Levefelt, discloses a rotary roller bit for drilling earth and rock formations which has a sealed lubrication system. The objective disclosed in that patent is to provide a barrier of air in the narrow space between the leg of the bit and the roller cutter to protect the seal from being damaged from debris. The periphery of each roller cutter is spaced from the adjacent portion of each leg so as to provide a jet slot for the discharge of air. Adjacent the slot and radially inwardly is an air chamber which is formed between an annular surface of the leg and the seal. Air is supplied through a passageway and is delivered to the air chamber and discharged from the chamber in a jet stream from the jet slot. The axial dimension of the air chamber is substantially greater than that of the slot so that the cross-sectional dimension of the path of air flow is substantially restricted as the air passes from the air chamber so as to produce a jet effect in the air flow. The air jet flowing from the jet slot is designed to prevent the entry of debris to the seal. However, one problem is that the jet slot has a dimension which is large enough for rock particles or other debris to enter. Furthermore, since the air from the air supply passageway passes into the air chamber and escapes from the jet slot wherever there is less resistance to air flow, this might create erratic air flow resulting in channeling and reverse flow conditions.

It is an object of this invention to provide a new and improved rotary blast hole bit which is sealed to retain lubricant for the bearings. Another object of the invention is to provide homogeneous air dissipation around the entire cone mouth to blow away borehole debris efficiently and uniformly, preventing air flow which results in channeling or reverse flow conditions, thereby protecting the sealing of the drill bit. It is a further object of this invention to use the homogeneous air dissipation around the cone mouth to protect an improved sealing arrangement.

SUMMARY OF THE INVENTION

This invention provides means for protecting the lubrication sealing arrangement of a rotary drill bit with air pressure. The rotary drill bit has a body with leg members with each of the leg members having a projecting, conical cutter receiving journal. A conical cutter, having an axially extending recess open at one end, is rotatably mounted onto the journal by the use of friction reducing bearings interior to the conical cutter. A main reservoir supplies lubrication fluid to conduits which extend into the bearings. When the region around the bearings is filled with lubricant, a seal positioned in a groove of the conical cutter retains the lubricant around the bearings. A porous gas restrictor is spaced outwardly from and concentric with the seal in the narrow space between the leg and the mouth of the conical cutter, thereby forming an annular chamber between the seal and the restrictor. A gas passageway interior to the body of the drill bit carries gas from a gas source into the annular chamber.

The porous gas restrictor allows dissipation of the pressurized gas, but the porosity of the restrictor is low enough that it maintains gas pressure in the annular chamber, resulting in the gas distributing evenly around the entire circumference of the annular chamber and the seal. Since the gas pressure is distributed evenly around the annular chamber, the dissipation of gas from the porous gas restrictor is a controlled dissipation with the dissipation being homogeneous at all points. This pressurized gas passing through the restrictor washes drilling debris away from the porous gas restrictor. All of the gas passageways through the porous gas restrictor are tiny pores which prevent drilling debris from getting past the restrictor into the annular chamber, while the positive gas pressure exiting through these pores keeps drilling debris away from the restrictor. If debris somehow enters into the annular chamber, the pressurized gas flowing past the seal and exiting past the porous gas restrictor keeps the debris away from the seal.

The means for protecting seals with pressurized air can be used with different sealing arrangements. One effective sealing arrangement includes an inner annular seal and an outer annular seal forming a circumferential seal gap between the seals, the seal gap being filled with lubricant. The conical cutter is adapted with seal receiving grooves at the open end of the recess to receive the inner and outer seals with the circumferential seal gap between the seals. The porous gas restrictor is spaced outwardly from and concentric with the outer annular seal, thereby forming an annular chamber between the outer seal and the restrictor. The inner seal is more resistant to lubricant under pressure than the outer seal and when a means for supplying lubricant to the circumferential seal gap is provided, lubricant in the seal gap will leak past the outer seal, and not the inner seal. The lubricant leaks into the annular chamber and past the porous gas restrictor. The lubricant and gas pressure exiting past the restrictor both help wash away drilling debris.

There are different embodiments for supplying lubricant to the circumferential seal gap. In one embodiment of the invention for supplying lubricant to the circumferential seal gap, a separate reservoir, which is preferably filled with a lubricant having a lower penetration value and a higher viscosity than the lubricant used in the bearings, supplies lubricant to conduits which open into the circumferential seal gap. A capillary size hole which opens into the bearings permits lubricant from the bearings to leak into conduits which also lead to the circumferential seal gap and to pressurize the lower penetration value lubricant. The lower penetration value and higher viscosity lubricant provides the primary protection to the seals. However, if this supply of lubricant runs low, the lubricant from the bearings backs up the supply of lower penetration value and higher viscosity lubricant and fills the circumferential seal gap.

In another embodiment, a one-way relief valve is connected to one of the bearings. When the lubricant around the bearings naturally expands from the heat of operation of the rotary drill bit, the fluid expands up a conduit past the relief valve into a relief valve reservoir. Once the lubricant is in the relief valve reservoir, it is directed to a conduit directly leading to the circumferential seal gap where it will bleed past the outer seal as described above.

In another embodiment of this invention, a separate reservoir for supplying lubricant to a conduit which opens into the circumferential seal gap is not needed. In this embodiment, the inner seal is a hydrodynamic seal. The hydrodynamic seal is designed to permit migration of lubricant from the bearings into the circumferential seal gap while preventing lubricant or contaminates from the circumferential seal gap from traveling past the hydrodynamic seal into the bearing region.

BRIEF DESCRIPTION OF THE DRAWINGS

Further features and advantages will become apparent from the following detailed description of the preferred embodiment of the invention, as illustrated in the accompanying drawings in which like reference characters refer to the same elements or functions throughout the views, and in which.

DETAILED DESCRIPTION

Figure 1:
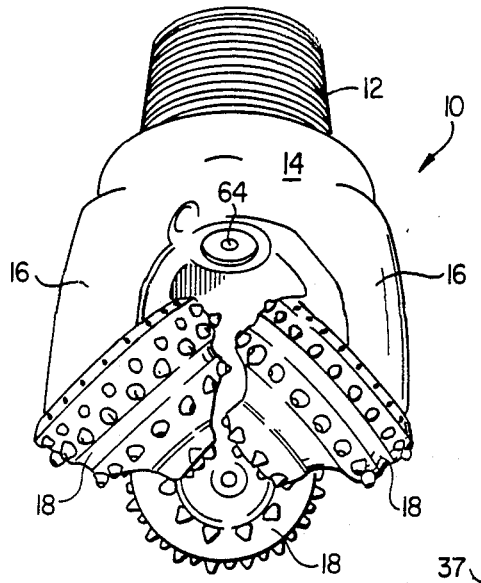
FIG. 1 is a perspective view of a rotary blast hole drill bit of the invention.

FIG. 1 illustrates a drill bit of the type to which the invention pertains. Drill bit 10 includes a top threaded portion 12 for threaded connection to a drill pipe (not shown). The body 14 of the drill bit has three legs 16 with conical cutters 18 attached. A nozzle 64 is also shown.

Figure 2:
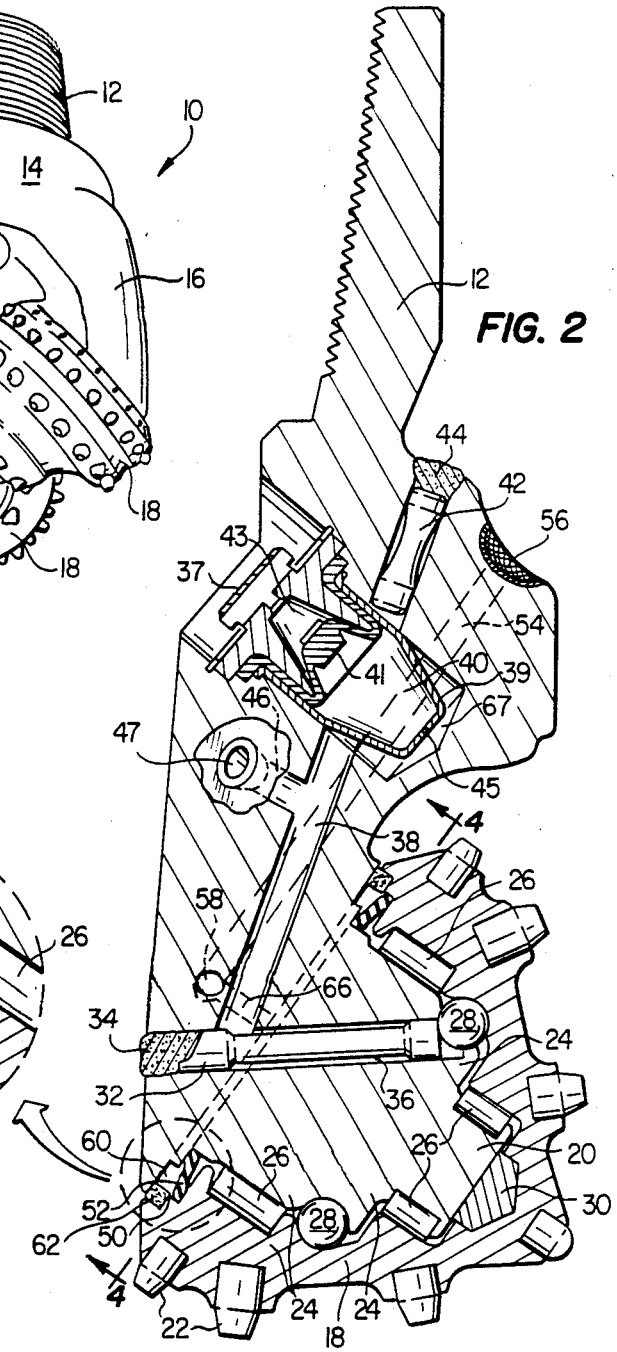
FIG. 2 is a cross-sectional view of one leg of the drill bit in FIG. 1, illustrating one embodiment of the invention.

FIG. 2 illustrates a partial cross-sectional view of drill bit 10 particularly showing the interior of one of the legs 16 with a conical cutter 18 attached. From FIG. 2, it can be seen that a portion of leg 16, hereinafter referred to as the journal 20, is angled with reference to the vertical axis, which includes the threaded portion 12. Journal 20 receives conical cutter 18. Conical cutter 18 includes several cutting teeth 22 which are the elements which cut through the earth during drilling operations. Races 24, which are annular grooves, are formed on the interior of conical cutter 18 and/or the exterior of journal 20 so that when the conical cutter is placed on the journal, these races will accommodate roller bearings 26 and ball bearings 28. A thrust button 30 is placed between journal 20 and conical cutter 18 to reduce stress between the journal and the conical cutter. Roller bearings 26 and ball bearings 28 provide for rotatable engagement between conical cutter 18 and journal 20, and also serve to retain the conical cutter in assembly with the journal. During assembly of the drill bit, ball bearings 28 are fed through a ball plug hole (not shown), and when the ball bearings are in place, ball plug 32 is inserted and secured by a weld 34. Ball plug 32 also contains a conduit 36 for carrying lubricant to roller bearings 26 and ball bearings 28. FIG. 2 also illustrates a main conduit 38 which is connected into a main reservoir 40 at one end and which is connected into the ball plug conduit 36 at the other end. Main reservoir 40 is comprised of a canister 39, diaphragm 41, and chamber 43 which is open to the environment when a plug 37 is in an open position (as illustrated). A lubricant filler hole 46 plugged with plug 47 is also connected to the main conduit 38.

When the main reservoir 40 is to be filled with lubricant, a vacuum is created inside leg 16 from lubricant filler hole 46. Lubricant is then supplied through lubricant filler hole 46 prior to being plugged with plug 47. This lubricant travels through main conduit 38, to ball plug conduit 36 and to roller and ball bearings 26 and 28. Lubricant also travels up main conduit 38 into region 67 near the bottom of main reservoir 40, into the main reservoir through a hole 45 in the main reservoir. Lubricant fills canister 39 in main reservoir 40 and the diaphragm 41 is stretched back into chamber 43. Diaphragm 41 has a tendency to contract back to its unstretched position and to thereby urge lubricant from canister 39 into region 67. As discussed, a cap 37 to main reservoir 40 is shown in an open position with chamber 43 open to the environment. Thus, when cap 37 is in the open position, diaphragm 41 is also exposed to the environment. Since drill bit 10 often operates in a high air pressure environment, the air pressure can act on stretched diaphragm 41 so the diaphragm tends to contract and urge lubricant into region 67. Drill bit 10 might also operate in a liquid environment, with the pressure of the liquid tending to force diaphragm 41 to contract. In any case, diaphragm 41 has a tendency to urge the lubricant into region 67 which leads to main conduit 38, to ball plug conduit 36, and to roller and ball bearings 26 and 28. Therefore, any lubricant lost from the bearings is replenished by lubricant from main reservoir 40.

FIG. 2 also illustrates an annular seal groove 50 which is formed in conical cutter 18. Seal groove 50 accommodates annular seal 52. When leg 16 is filled with lubricant, seal 52 retains the lubricant in the region around the bearings. A porous gas restrictor 62 is spaced outwardly from and concentric with seal 52 in the narrow space between the leg 16 and the mouth of conical cutter 18, thereby forming an annular chamber 60 between the seal and the restrictor.

Also illustrated in FIG. 2 is a main gas passageway 54. A screen 56 is attached across the outer end of the main gas passageway 54. Main gas passageway 54 is designed to carry gas, typically air, from a gas source. Screen 56 is designed to prevent any debris from entering into main gas passageway 54. A passageway 58, which is in a plane perpendicular to the longitudinal axial plane of the main gas passageway 54, intersects the end of the main gas passageway opposite to screen 56. See FIG. 4. Two passageways 66 provide fluid communication from passageway 58 to chamber 60. One of the passageways 66 opens into one end of passageway 58 and extends and opens into one side of annular chamber 60. For further explanation and illustration see FIG. 4. The other passageway 66 opens into the other end of passageway 58 and extends and opens into the opposite side of chamber 60. See FIG. 4. The positioning of main gas passageway 54 and/or of main reservoir 40 can be designed such that the air pressure of the air carried in the main gas passageway will act on stretched diaphragm 41 so that the diaphragm will tend to contract and urge lubricant into region 67 and eventually into the roller and ball bearings 26 and 28. See U.S. Pat. No. 4,375,242, by Galle.

Figure 3:
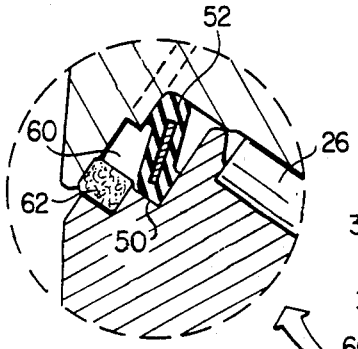
FIG. 3 is a cross-sectional view illustrating an enlarged view of the region around the sealed portion of the drill bit of FIG. 2.

FIG. 3 illustrates an enlarged view of annular seal groove 50, seal 52, chamber 60 and porous gas restrictor 62. Seal 52 is of a face seal design such as a lip compression seal or a spring compression seal. A spring compression seal called a belleville seal is illustrated. The porous gas restrictor 62 should be made out of material strong enough to withstand the stresses of operation of the drill bit 10. A metallurgical material, such as bronze micro-beads fused together, provides suitable strength. The metallurgical material should be formed so that it is porous and so that the porous gas restrictor has a porosity of between 10%.–50%. A corporation called Mott Metallurgical Corporation makes suitable porous-metal gas restrictors.

Figure 4:
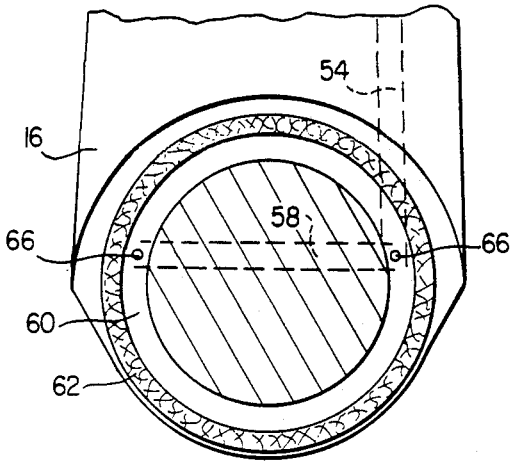
FIG. 4 is a cross-sectional view of the drill bit on line 4—4 of FIG. 2.

FIG. 4 illustrates the cross-sectional view of leg 16 illustrated in FIG. 2 taken along line 4—4. The cross-sectional view illustrated in FIG. 4 is in a plane perpendicular to the cross-sectional view illustrated in FIG. 2. The entire circumference of annular chamber 60 and circumferential porous gas restrictor 62 is shown. Also shown in the view in this plane is the entire length of gas passageway 58, which has one end at approximately the three o'clock position in the reference of FIG. 4 on annular chamber 60 and another end at approximately the nine o'clock position. Passageways 66 which extend from gas passageway 58 into chamber 60 can also be seen. Main gas passageway 54 extends and opens into gas passageway 58 at the passageway end that is located at approximately the three o'clock position.

When leg 16 is filled with lubricant, seal 52 retains the lubricant in the region around the bearings and excludes foreign material from entering the region. Pressurized gas, typically air, at a pressure of 30–40 p.s.i.g. is supplied into main gas passageway 54. The pressurized gas travels through passageway 58 and passageways 66 into annular chamber 60. Although porous gas restrictor 62 allows dissipation of pressurized gas through its pores, its porosity is low enough so that it maintains gas pressure at approximately 30–40 p.s.i.g. in the groove, resulting in pressurized gas distributing evenly around the entire circumference of the groove and the seal 52. Since pressurized gas is distributed evenly around chamber 60, any dissipation of gas through porous gas restrictor 62 is a controlled dissipation and the dissipation is homogeneous at all points. The dissipation of gas past porous gas restrictor 62 has a pressure of approximately 30–40 p.s.i.g. as it exits the porous gas restrictor. The pressurized gas washes away drilling debris. Although the porous gas restrictor 62 is indeed porous, the size of the pores are tiny enough to prevent drilling debris from getting past it into chamber 60, but the positive gas pressure flowing through the gas restrictor pores keeps drilling debris away. The pressurized gas around seal 52 shields the seal from any debris that might enter into annular chamber 60. The density of the porous gas restrictor is determined prior to assembly of the drill bit 10 depending on the source volume and pressure available at the drill rig and so as to achieve the desired air dissipation through porous gas restrictor 62 and maintains the desired back pressure maintained within the annular chamber 60.

The remaining FIGURES, FIGS. 5–8B, illustrate different embodiments of the invention, but with all the embodiments each having passageways for carrying pressurized gas to a circumferential groove enclosed by a porous gas restrictor where the pressurized gas protects a seal having an exposed surface into the groove. These different embodiments illustrate improved sealing arrangements involving an inner and outer seal having a circumferential seal gap supplied with lubricant located between the seals.

Figure 5:
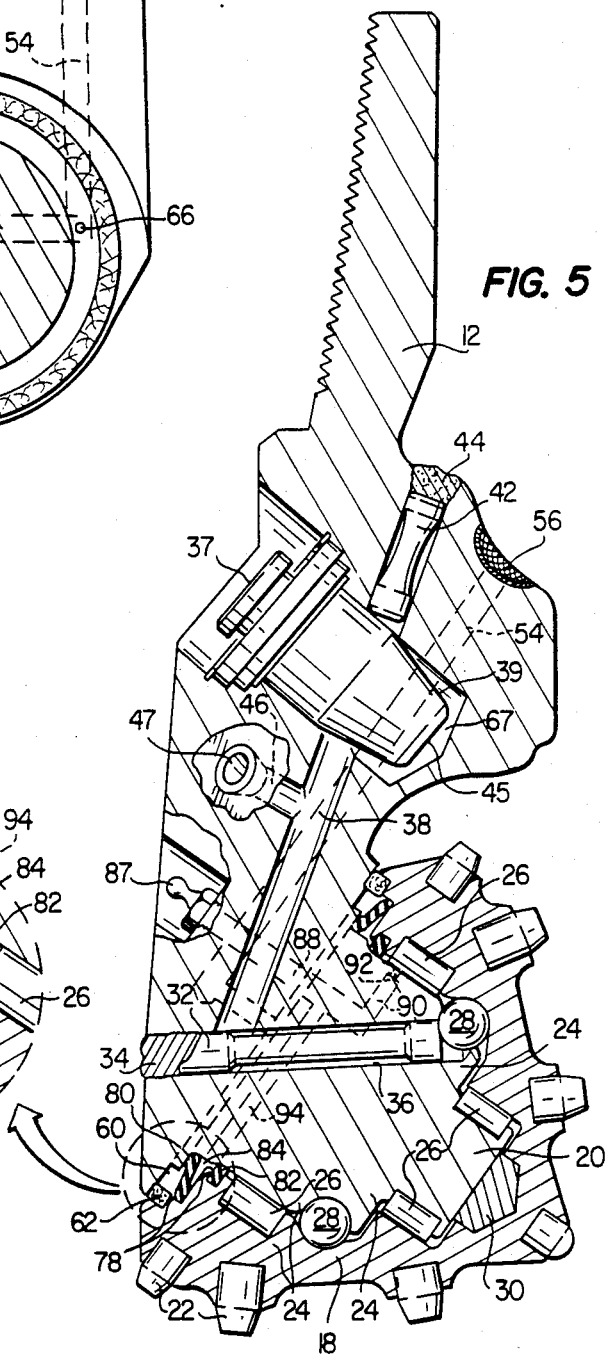
FIG. 5 is a cross-sectional view of one leg of the drill bit of FIG. 1, illustrating a second embodiment of the invention.

As illustrated in FIG. 5, annular seal grooves 78 are formed in conical cutter 18. Seal grooves 78 accommodate an annular outer seal 80 and an annular inner seal 82 in coaxial relationship. A circumferential seal gap 84 is located between outer seal 80 and inner seal 82. A conduit 88 holds lubricant which is to be provided specifically to the circumferential seal gap 84. A capillary size hole 92 which is connected into the region of roller bearings 26 is connected to a conduit 90. Conduit 90 is also connected to conduit 88. The conduit 88 is tied to a conduit 94 which directly leads to and opens into circumferential seal gap 84.

When the leg 16 is filled with lubricant, inner seal 82 seals the lubricant into the region around the bearings. The conduit 88 is also filled with a lubricant and this lubricant is directed into the conduit 94 which directs the lubricant into the circumferential seal gap 84. The conduit 88 is provided with a Zerk fitting 87 at the end of the conduit closest to the exterior of leg 16. Zerk fitting 87 is a one-way fitting which only permits lubricant, supplied from an external source, to travel in the direction into conduit 88. As will be explained in more detail below, conduit 88 is preferably supplied with lower penetration value lubricant than the lubricant placed in main reservoir 40. As will also be explained in more detail below, the capillary size hole 92 slowly leaks out lubricant from the bearing region into conduit 90 which directs the lubricant into conduit 88. Seal gap reservoir conduit 88 directs the fluid into the circumferential seal gap conduit 94 leading to circumferential seal gap 84.

Figure 6:
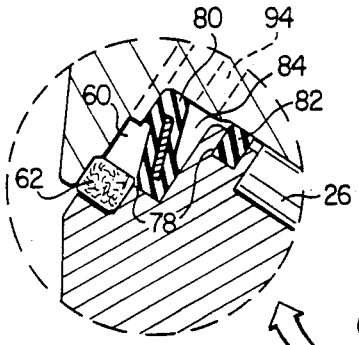
FIG. 6 is a cross-sectional view illustrating an enlarged view of the region around the sealed portion of the drill bit in FIG. 5.

FIG. 6 illustrates an enlarged view of seals 50 and 52 and the region around the seals including seal grooves 78, circumferential seal gap 84, circumferential seal gap conduit 94, annular chamber 60, and porous gas restrictor 62. Outer seal 80 is of a face seal type such as lip compression seal or a spring compression seal. A spring compression seal called a belleville seal is illustrated in FIGS. 5 and 6. The inner seal 82 is a shaft seal such as an O-ring. An O-ring seal called a 1.4 to 1 O-ring seal is an effective seal. The outer seal 80 or face seal is designed such that when lubricant from conduit 94 directs a sufficient amount of lubricant into the circumferential seal gap 84, the pressure of this lubricant will force the outer seal 80 to open and allow the lubricant to bleed out into annular chamber 60 and past porous gas restrictor 62 into the environment. The inner seal 82 or shaft seal is designed to be more resistant to the pressures created by the lubricants and will not open under the presence of lubricant from the circumferential seal gap 84 or lubricant from the bearings. The inner seal 82 thus prevents the loss of lubricant from the bearings, and prevents lubricant or contaminates from the circumferential seal gap 84 from entering into the bearing region. The bleeding of lubricant past outer seal 80 and eventually past porous gas restrictor 62 into the environment provides other means, besides the air pressure, of washing away drilling debris. Furthermore, although inner seal 82 provides a barrier to the entry of drilling debris into the bearing region, the outer seal 80, the bleeding action past the outer seal and the lubricant filled circumferential seal gap 84 provide additional protection to the inner seal. The longer the integrity of the inner seal is protected, the longer the lubricant will stay in the bearing region and extend the life of the drill bit. Unlike in prior art patents, a main reservoir 40 is provided with a large enough supply of lubricant specifically for replenishing lubricant to the bearings because of lubricant loss past outer seal 80, such that drill bit 10 can be operated for long periods of time before requiring refilling.

The lubricant for the bearings is made of a mineral oil having a viscosity of between 50 to 200 centistokes at 40° C. (ideally 108 centistokes) mixed with a calcium complex soap base to form a grease. The grease from the bearings should have an ASTM worked penetration in the range of 310 to 400 mm, with an ideal penetration of 350 mm. A grease having a lower penetration value than the lubricant for the bearings has been found to be most effective at washing away any drilling debris and preventing the drilling debris from entering circumferential seal gap 84 and getting to the inner seal 82. The grease for the circumferential seal gap 84 should have an ASTM worked penetration of 175 to 250 mm, with an ideal penetration somewhere in the middle of this range. The lower penetration value grease is made up of mineral oil having a viscosity of 500 to 1000 centistokes at 40° C. (ideally 640 centistokes) mixed with a calcium complex soap base. Since conduit 88, the conduit 94 and the circumferential seal gap 84 can be filled with only a limited supply of this lower penetration value lubricant, means for providing a backup lubricant to the circumferential seal gap is provided as shown in the embodiment in FIG. 5. In this embodiment, the lower penetration value seal gap lubricant first fills the circumferential seal gap 84. During operation of the drill bit, the lower penetration value seal gap lubricant expands and increases in pressure from its initial pressure to a higher operating pressure due to heat and eventually some of the lower penetration value seal gap lubricant bleeds past outer seal 80. At the same time, the higher penetration value bearing lubricant from the bearings also expands and increases in pressure from its initial pressure to a higher operating pressure due to the heat of operation and slowly leaks through the capillary size hole 92 into conduit 90 leading to the conduit 88. The initial pressure of the supply of seal gap lubricant can be less than or equal to the initial pressure of the bearing lubricant in the bearings. The operating pressure of the supply of seal gap lubricant will be greater than initial pressure of the supply of seal gap lubricant and can be greater than the initial pressure of the bearing lubricant in the bearings. Similarly, the operating pressure of the bearing lubricant in the bearings can be greater than or equal to the operating pressure of the supply of seal gap lubricant. When the operating pressure of the supply of seal gap lubricant is higher than the initial pressure of the supply of seal gap lubricant, the rate of passage of seal gap lubricant from its supply into the annular seal gap increases from a first rate at the initial pressure of the supply of seal gap lubricant to a second, higher rate at the operating pressure of the supply of seal gap lubricant. Since the conduit 88 and the conduit 94 are filled first with viscous lubricant, most of the higher penetration value lubricant follows behind the lower penetration value lubricant. The higher penetration value lubricant pressurizes the lower penetration value lubricant into the circumferential seal gap 84 and past outer seal 80. Some of this higher penetration value lubricant mixes with the lower penetration value lubricant. Furthermore, in the event that all the lower penetration value lubricant is lost, the higher penetration value lubricant will solely fill the circumferential seal gap 84 and eventually bleed past outer seal 80, thereby providing continued protection of the seals.

The separate supply of lower penetration value lubricant can also be eliminated from the embodiment shown in FIG. 5. In this case, conduits 88, 90, and 94 would be initially filled with the bearing lubricant. During operation of the drill bit the capillary size hole 92 would leak additional lubricant from the bearings into conduit 90. Lubricant would then be directed to circumferential seal gap 84 and bleed past outer seal 80 to wash away drilling debris.

Figure 7:
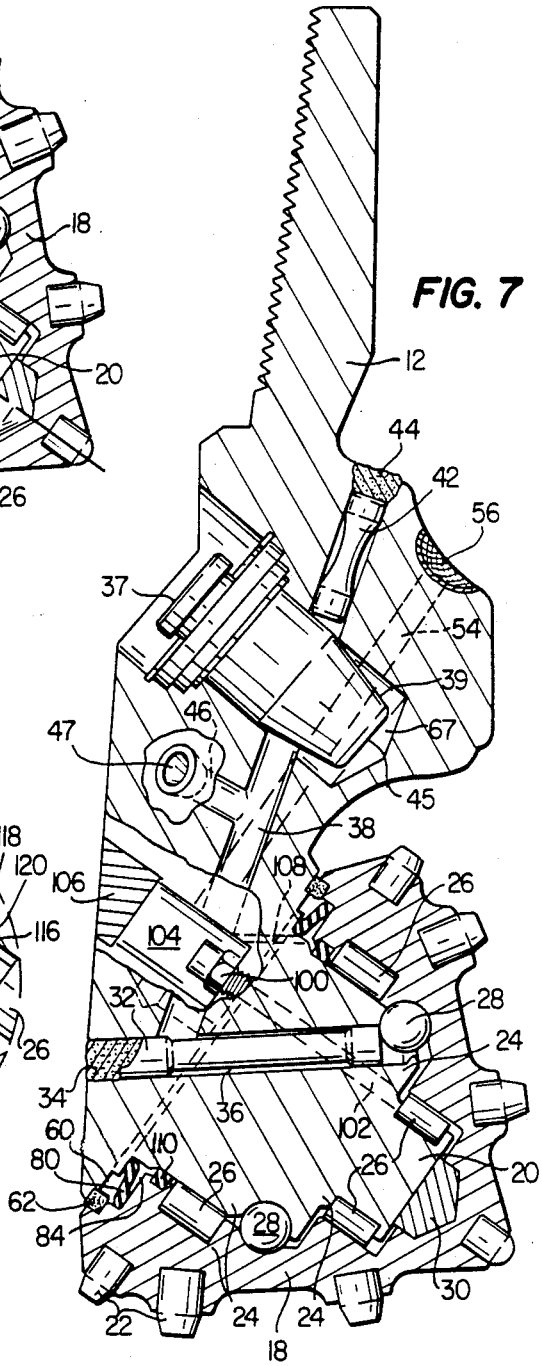
FIG. 7 is a cross-sectional view of one leg of the drill bit of FIG. 1, illustrating a third embodiment of the invention.

FIG. 7 illustrates another embodiment of the invention. As can be seen in FIG. 7, the drill bit design is essentially the same except for the means of supplying lubricant to the circumferential seal gap 84. A one-way relief valve 100 is connected into the region around the roller bearings 26 by a relief valve conduit 102. While one end of the relief valve 100 is connected to the relief valve conduit 102, the other end of the relief valve opens into a reservoir 104. Relief valve reservoir 104 is welded into place by weld 106. Relief valve reservoir 104 has an opening to which conduit 108, which leads to the circumferential seal gap 84, is tied. Normally in prior drill bits, the main reservoir is underfilled to account for the normal expansion of lubricant during operation of the drill bit. In this embodiment, main reservoir 40 is initially filled to 100% of its capacity. When drill bit 10 of this embodiment is under operation, lubricant from main reservoir 40 is supplied to the bearings as usual. However, as the lubricant expands and increases in pressure due to the normal heating of the drill bit 10 under operation, it travels up relief valve conduit 102 towards relief valve 100. When the expanding lubricant reaches relief valve 100, it travels through the relief valve into relief valve reservoir 104. Since relief valve 100 is a one-way relief valve, lubricant only travels up through relief valve conduit 102 into relief valve reservoir 104 and does not travel back into the conduit 102. Once relief valve reservoir 104 begins to fill with lubricant, this lubricant will then travel to conduit 108 which leads to circumferential seal gap 84. Thus, circumferential seal gap 84 fills with lubricant and this lubricant will bleed past outer seal 80 to protect the seals against drilling debris as explained above with regard to FIGS. 5 and 6.

Figure 8A:
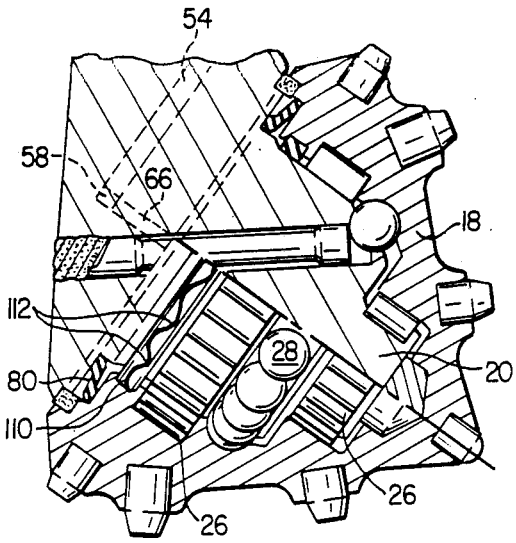
FIG. 8A is a partial cross-sectional view of one leg of the drill bit of FIG. 1, illustrating a fourth embodiment of the invention.
Figure 8B:
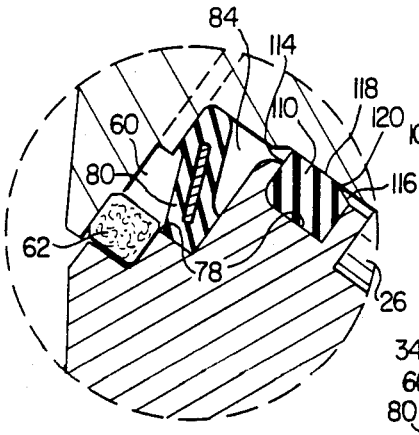
FIG. 8B is a cross-sectional view illustrating an enlarged view of the sealed portion of the invention illustrated in FIG. 8A.

FIGS. 8A and 8B illustrate another embodiment of this invention. In this embodiment, the inner seal 82 is a hydrodynamic lubricant seal of the type taught in U.S. Pat. No. 4,610,319 issued to Kalsi. To the extent that this patent teaches the design, function and use of a hydrodynamic seal, it is incorporated herein by reference. When a hydrodynamic seal is used as inner seal 82, it permits dissipation of lubricant from the bearing region into the circumferential seal gap 84 but does not permit lubricant or contaminates to travel from the circumferential seal gap past the hydrodynamic seal. Since this hydrodynamic seal provides lubricant to the circumferential seal gap, the separate means of supplying lubricant to the circumferential seal gap, in the embodiments illustrated in FIGS. 5 and 7, are not necessary.

In FIGS. 8A and 8B, the hydrodynamic seal is identified as 110. As discussed in U.S. Pat. No. 4,610,319, a hydrodynamic seal of the type including hydrodynamic seal 110 in FIGS. 8A and 8B, is provided with a different geometry on the side containing the lubricant for bearings 26 and 28, where promotion of hydrodynamic lubrication is intended, than the seal geometry on the circumferential seal gap side where avoidance of any hydrodynamic activity is desirable. Hydrodynamic seal 110 is designed in a generally circular form having a hydrodynamic shape on the side containing lubricant for bearings 26 and 28 which defines a plurality of waves 112. The amplitude and shape of waves 112 is selected to create a desirable amount of hydrodynamic film due to the relative motion at the hydrodynamic seal 110 interface. On the circumferential seal gap 84 side of the hydrodynamic seal 110, the geometry of the seal can take a number of forms which substantially prevent any hydrodynamic activity due to the relative motion between the seal and the conical cutter 18. The geometry of the hydrodynamic seal 110 on the circumferential seal gap 84 side also successfully substantially combats any wedging action of drilling debris particles due to the relative axial movement between the hydrodynamic seal on the lubricant side and the counterface of the conical cutter 18. In its simplest form, hydrodynamic seal 110 contains a series of sinusoidal waves 112 on the lip exposed to the lubricant side and a planar annular cylindrical surface 84 on the circumferential seal gap 84 side. The geometry of the waves 112 on the lubricant side is selected so as to create a film thickness of desirable magnitude but still maintain a dissipation rate as low as possible and compatible with the main reservoir 40 volume available. More specifically, on the circumferential seal gap 84 side, hydrodynamic seal 110 presents a substantially non-converging edge 114 to contaminates such as drilling fluid to prevent the drilling fluid from developing any degree of hydrodynamic lift as relative rotation occurs between the seal and the surface against which it seals. The non-converging shape also prevents any hydrodynamic lifting activity during relative axial motion between the hydrodynamic seal 110 on the lubricant side and the conical cutter 18.

At its lubricant interface, hydrodynamic seal 110 defines a surface forming a plurality of waves 112 which may be in the form of smooth sine waves or waves of differing design. The sealing element on the lubricant side is formed to define an undulating hydrodynamic geometry forming an inclined surface 116, as viewed in the cross section shown in FIG. 8B, that cooperates with the circular metal sealing surface 118 of the journal to form a hydrodynamic entrance zone of greater width toward the lubricant chamber and gradually tapering to a minimal dimension at the point of contact 120. The undulating surface geometry establishes a seal contact width that varies circumferentially depending on the location of the seal cross section being considered. The gradually tapering surface of hydrodynamic seal 110 at its point of contact 120 with the relatively rotatable metal sealing surface 118 of the journal 20 defines a merging radius to prevent or minimize any scraping activity that might interfere with the flow of lubricant film toward the circumferential seal gap 84. As relative rotation occurs between hydrodynamic seal 110 and journal 20 the undulating design of the seal at the lubricant interface surface causes development of hydrodynamic lifting forces at the contact between the seal and the relatively rotating metal sealing surface 118. These forces cause slight lifting of the sealing material of hydrodynamic seal 110 from the metal sealing surface and thus develop a minute pumping activity causing an extremely small but definite quantity of lubricant to migrate under hydrodynamic influence from the lubricant interface of the seal member toward the circumferential seal gap 84. When a sufficient amount of the lubricant migrates into the circumferential seal gap 84, this will force open outer seal 80 allowing lubricant to bleed past. Furthermore, the separation caused by the introduction of a hydrodynamic lubricant film at the seal interface of hydrodynamic seal 110 with the metal sealing surface 118 eliminates direct rubbing contact and the associated wear. It also ensures continuous maintenance of minimal friction between hydrodynamic seal 110 and the metal sealing surface 118 and maintains a low temperature environment to thus ensure enhanced operational life of the seal.

While the foregoing illustrates and discloses the preferred embodiment of the invention with respect to the composition of the drill bit, it is to be understood that many changes can be made to the drill bit design, such as the type of bearings used, and the type of porous gas restrictor, the sealing arrangement, and the application of the drill bit as a matter of engineering choices without departing from the spirit and scope of the invention, as defined by the appended claims.

I claim:

1. In a sealed rotary drill bit suitable for use with a rotating drill pipe for drilling shallow holes in the absence of liquid drilling mud, said drill bit having a body with a plurality of cutting elements, each of the cutting elements comprising a leg member having a projecting, conical cutter receiving journal, a conical cutter having an axially extending recess open at one end, and friction reducing bearings interior to the cutting element for rotatably mounting the conical cutter on the journal in spaced relationship with the journal, the improvement comprising:

(a) each cutting element having at least one annular seal at the open end of the respective recess;

(b) each cutting element having a circumferential porous gas restrictor concentric with and exterior to the respective at least one annular seal, the circumferential porous gas restrictor being spaced from the respective at least one annular seal to form an annular gas chamber therebetween; and (c) each leg member having a gas passageway extending into the respective annular gas chamber to carry pressurized gas into the respective annular gas chamber, each circumferential porous gas restrictor being formed of metal particles fused together such that the circumferential porous gas restrictor is strong enough to withstand the stresses of operation of the drill bit while providing a porosity which is capable of maintaining the pressure of the gas in the respective annular gas chamber while permitting some pressurized gas to be dissipated through its pores evenly around the circumference of the respective annular chamber.

2. A drill bit in accordance with claim 1, wherein the at least one annular seal of each cutting element comprises an annular face seal at the open end of the respective recess.

3. In a drill bit having a body with a plurality of cutting elements, each of the cutting elements comprising a leg member having a projecting conical cutter receiving journal, a conical cutter having an axially extending recess open at one end, and friction reducing bearings interior to the cutting element for rotatably mounting the conical cutter on the journal in spaced relationship with the journal, the improvement comprising:

(a) each cutting element having an outer annular seal and an inner annular seal at the open end of the respective recess in coaxial relationship with each other, with a circumferential seal gap between the two seals, each such outer annular seal having less resistance to the flow of lubricating fluid in the direction from the circumferential seal gap to the open end of the conical cutter than the resistance to the flow of lubricating fluid in each such inner annular seal;

(b) each cutting element having, in its interior, a mechanism which directs lubricating fluid into the respective circumferential seal gap, the lubricating fluid eventually exiting past the respective outer annular seal;

(c) each cutting element having a circumferential porous gas restrictor concentric with and exterior to the respective outer annular seal, the circumferential porous gas restrictor being spaced rom the respective outer annular seal to form an annular gas chamber therebetween; and (d) each leg member having a gas passageway extending into the respective annular gas chamber to carry pressurized gas into the respective annular gas chamber, the circumferential porous gas restrictor being capable of maintaining the pressure of the gas in the annular gas chamber while permitting lubricant which has exited past the outer seal and some pressurized gas to be disengaged through its pores.

4. A drill bit in accordance with claim 3, wherein each outer annular seal is a face seal.

5. A drill bit in accordance with claim 3, wherein each inner annular seal is a shaft seal.

6. In a drill bit having a body with a plurality of cutting elements, each of the cutting elements comprising a leg member having a projecting, conical cutter receiving journal, a conical cutter having an axially extending recess open at one end, and friction reducing bearings interior to the cutting element for rotatably mounting the conical cutter on the journal in spaced relationship with the journal, the improvement comprising:

(a) each cutting element having an outer annular seal and an inner annular seal at the open end of the respective recess in conical relationship with each other, with a circumferential seal gap between the two seals, each such outer annular seal having less resistance to the flow of lubricating fluid in the direction from the circumferential seal gap to the open end of the conical cutter than the resistance to the flow of lubricating fluid in each such inner annular seal;

(b) each cutting element having, in its interior, a lubricating fluid carrying conduit with a oneway valve between the respective bearings and the respective circumferential seal gap which directs lubricating fluid from the respective bearings into the respective circumferential seal gap, the lubricating fluid eventually exiting past the respective outer annular seal;

(c) each cutting element having a circumferential porous gas restrictor concentric with and exterior to the respective outer annular seal, the circumferential porous gas restrictor being spaced from the respective outer annular seal to form an annular gas chamber therebetween; and (d) each leg member having a gas passageway extending into the respective annular gas chamber to carry pressurized gas into the respective annular gas chamber, the circumferential porous gas restrictor being capable of maintaining the pressure of the gas in the annular gas chamber while permitting lubricant which has exited past the outer seal and some pressurized gas to the dissipated through its pores.

7. A drill bit in accordance with claim 6, wherein each outer annular seal is a face seal.

8. A drill bit in accordance with claim 6, wherein each inner annular seal is a shaft seal.

9. In a drill bit having a body with a plurality of cutting elements, each of the cutting elements comprising a leg member having a projecting, conical cutter receiving journal, a conical cutter having an axially extending recess open at one end, and friction reducing bearings interior to the cutting element for rotatably mounting the conical cutter on the journal in spaced relationship with the journal, the improvement comprising:

(a) each cutting element having an outer annular seal and an inner annular seal at the open end of the respective recess in coaxial relationship with each other, with a circumferential seal gap between the two seals, each such outer annular seal having less resistance to the flow of lubricating fluid in the direction from the circumferential seal gap to the open end of the conical cutter than the resistance to the flow of lubricating fluid in each such inner annular seal;

(b) each cutting element having a lubricating fluid carrying conduit in its interior which extends into the respective circumferential seal gap and directs a second lubricating fluid, which has a lower penetration value than a first lubricating fluid in the bearings, into the respective circumferential seal gap, the second lubricating fluid eventually exiting past the respective outer annular seal;

(c) each cutting element having, in its interior, a capillary which leaks the first lubricating fluid from the respective bearings into the conduit extending into the circumferential seal gap thereby directing the first lubricating fluid from the respective bearings into the respective circumferential seal gap and thereby further pressuring the second lubricating fluid into the respective circumferential seal gap;

(d) each cutting element having a circumferential porous gas restrictor concentric with and exterior to the respective outer annular seal, the circumferential porous gas restrictor being spaced from the respective outer annular seal to form an annular gas chamber therebetween; and (e) each leg member having a gas passageway extending into the respective annular gas chamber to carry pressurized gas into the respective annular gas chamber, the circumferential porous gas restrictor being capable of maintaining the pressure of the gas in the annular gas chamber while permitting lubricant which has exited past the outer annular seal and some pressurized gas to be dissipated through its pores.

10. A drill bit in accordance with claim 9, wherein each outer annular seal is a face seal.

11. A drill bit in accordance with claim 9, wherein each inner annular seal is a shaft seal.

12. In a drill bit having a body with a plurality of cutting elements, each of the cutting elements comprising a leg member having a projecting conical cutter receiving journal, a conical cutter having an axially extending recess open at one end, and friction reducing bearings interior to the cutting element for rotatably mounting the conical cutter on the journal in spaced relationship with the journal, the improvement comprising:

(a) each cutting element having an outer annular seal and an inner annular seal at the open end of the respective recess in coaxial relationship with each other with a circumferential seal gap between the two seals, each outer annular seal being a face seal and each inner annular seal being a hydrodynamic seal, each such face seal having less resistance to the flow of lubricating fluid in the direction from the circumferential seal gap to the open end of the conical cutter than the resistance to the flow of lubricating fluid of each hydrodynamic seal on its circumferential seal gap side, the hydrodynamic seal being designed and positioned such that the side of the hydrodynamic seal facing the circumferential seal gap has a shape to prevent lubricating fluid or contaminants from the circumferential seal gap side from getting past it to the other side of the hydrodynamic seal, while the other side of the hydrodynamic seal has a dynamic surface such that when there is lubricating fluid around the bearings the dynamic surface carries some lubricating fluid into the circumferential seal gap, the lubricating fluid carried into the circumferential seal gap eventually exiting past the respective outer annular seal;

(b) each cutting element having a circumferential porous gas restrictor concentric with and exterior to the respective outer annular seal, the circumferential porous gas restrictor being spaced from the respective outer annular seal to form an annular gas chamber therebetween; and (c) each leg member having a gas passageway extending into the respective annular gas chamber to carry pressurized gas into the respective annular gas chamber, the circumferential porous gas restrictor being capable of maintaining the pressure of the gas in the respective annular gas chamber while permitting lubricant which has exited past the respective outer annular seal and some pressurized gas to be dissipated through its pores.

13. A method of lubricating a plurality of circumferential seal gaps, each circumferential seal gap being located between a respective pair, in a plurality of pairs, of annular seals wherein the two annular seals in a pair are positioned in coaxial relationship with each other, and of utilizing air pressure to protect the outer annular seal of the two seals in a pair, the pairs of annular seals being in a drill bit having a body with a plurality of cutting elements, each such cutting element comprising a leg member having a projecting, conical cutter receiving journal, a conical cutter having an axially extending recess open at one end, friction reducing bearings interior to the cutting element for rotatably mounting the conical cutter on the journal in spaced relationship with the journal, and at least one lubricating fluid carrying conduit interior to the leg member and extending into the bearings, each pair of seals being an outer annular seal and an inner annular seal positioned at the open end of the axially extending recess of a respective conical cutter in coaxial relationship with each other to form a circumferential seal gap between the respective outer annular seal and the respective inner annular seal, each such outer annular seal having less resistance to the flow of lubricating fluid in the direction from the respective circumferential seal gap to the open end of the respective conical cutter than the resistance to the flow of lubricating fluid in the respective inner annular seal, each cutting element having at least one lubricating fluid carrying conduit interior to the respective cutting element to carry lubricating fluid into the respective circumferential seal gap, each cutting element having a circumferential porous gas restrictor concentric and exterior to the respective outer annular seal with the respective circumferential porous gas restrictor being spaced from the respective outer annular seal to form an annular gas chamber therebetween, and each leg member having a gas passageway extending into the respective annular gas chamber to carry pressurized gas into the respective annular gas chamber, the respective circumferential porous gas restrictor maintaining the pressure of the gas in the respective annular gas chamber, comprising the steps of:

(a) providing for each cutting element a body of lubricating fluid at a respective first pressure;

(b) when a body of lubricating fluid is at said first pressure, passing lubricating fluid from the respective body of lubricating fluid into the respective bearings by the respective at least one lubricating fluid carrying conduit extending into the bearings;

(c) operating the drill bit for a period of time such that the temperature of the lubricating fluid in the respective bearings increases, thereby causing the lubricating fluid to expand and increase the pressure of the lubricating fluid to a second pressure which is higher than said first pressure;

(d) whenever such lubricating fluid is at said second pressure, passing lubricating fluid from the respective bearings to the respective circumferential seal gap by the respective at least one lubricating carrying conduit extending into the respective circumferential seal gap;

(e) passing pressurized gas through each gas passageway into each annular gas chamber;

(f) maintaining the pressure of the pressurized gas in each annular gas chamber by the use of the respective circumferential porous gas restrictor; and (g) permitting lubricant which has exited past each respective outer annular seal and some pressurized gas in each respective annular gas chamber to be dissipated through the pores of the respective porous gas restrictor.

14. A method of lubricating a plurality of circumferential seal gaps, each circumferential seal gap being located between a respective pair, in a plurality of pairs, of annular seals wherein the two annular seals in a pair are positioned in coaxial relationship with each other, and of utilizing air pressure to protect the outer annular seal of the two seals in a pair, the pairs of annular seals being in a drill being having a body with a plurality of cutting elements, each such cutting element comprising a leg member having a projecting, conical cutter receiving journal, a conical cutter having an axially extending recess open at one end, friction reducing bearings interior to the cutting element for rotatably mounting the conical cutter on the journal in spaced relationship with the journal, and a first lubricating fluid carrying conduit interior to the cutting element and extending into the bearings, each pair of seals being an outer annular seal and an inner annular seal positioned at the open end of the axially extending recess of a respective conical cutter in coaxial relationship with each other to form a circumferential seal gap between the respective outer annular seal and the respective inner annular seal, each such outer annular seal having less resistance to the flow of lubricating fluid in the direction from the respective circumferential seal gap to the open end of the respective conical cutter than the resistance to the flow of lubricating fluid in the respective inner annular seal, each cutting element having second and third lubricating fluid carrying conduits interior to the respective cutting element extending into the respective circumferential seal gap, each cutting element having a circumferential porous gas restrictor concentric and exterior to the respective outer annular seal with the respective circumferential porous gas restrictor being spaced from the respective outer annular seal to form an annular gas chamber therebetween, and each leg member having a gas passageway extending into the respective annular gas chamber to carry pressurized gas into the respective annular gas chamber, comprising the steps of:

(a) providing for each cutting element a first body of bearing lubricating fluid at a respective first pressure;

(b) when a first body of bearing lubricating fluid is at the respective first pressure, passing bearing lubricating fluid from the respective first body of bearing lubricating fluid into the respective bearings by the respective first lubricating fluid carrying conduit;

(c) providing for each cutting element a second body of seal gap lubricating fluid contained entirely within the drill bit at a respective second pressure which is less than or equal to the respective first pressure;

(d) passing seal gap lubricating fluid at the respective second pressure from the respective second body of seal gap lubricating fluid to the respective circumferential seal gap at a first rate by the respective second lubricating fluid carrying conduit;

(e) operating the drill bit for a period of time such that the temperature of the respective second body of seal gap lubricating fluid, including the seal gap lubricating fluid in the respective second lubricating fluid carrying conduit, increases, thereby causing the seal gap lubricating fluid to expand and increase the pressure of the seal gap lubricating fluid to a respective third pressure which is greater than the respective first or said second pressures, thereby causing said seal gap lubricating fluid to pass into the respective circumferential seal gap at a second rate greater than said first rate;

(f) operating the drill bit for a period of time such that the temperature of the bearing lubricating fluid in the respective bearings increases, thereby causing the respective bearing lubricating fluid to expand and increase the pressure on the bearing lubricating fluid in the respective bearings to a fourth pressure which is greater than or equal to said third pressure;

(g) passing bearing lubricating fluid at the respective fourth pressure from the respective bearings into the respective circumferential seal gap by the respective third lubricating fluid carrying conduit thereby further pressuring the seal gap lubricating fluid in the respective circumferential seal gap;

(h) passing pressurized gas through each gas passageway into each annular gas chamber;

(i) maintaining the pressure of the pressurized gas in each annular gas chamber by the use of the respective circumferential porous gas restrictor; and (j) permitting lubricant which has exited past each respective outer annular seal and some pressurized gas in each respective annular gas chamber to be dissipated through the pores of the respective porous gas restrictor.

15. A rotary drill bit in accordance with claim 1, wherein the porosity of each circumferential porous gas restrictor is in the range 10% to 50%, with the gas passageways through the circumferential porous gas restrictor being small enough to prevent drilling debris from getting past the circumferential porous gas restrictor into the respective annular gas chamber.

16. A rotary drill bit in accordance with claim 1, wherein the metal particles are micro-beads.

17. A rotary drill bit in accordance with claim 3, wherein each circumferential porous gas restrictor is formed of metal particles fused together such that each circumferential porous gas restrictor is strong enough to withstand the stresses of operation of the drill bit while providing a porosity which is capable of maintaining the pressure of the gas in the respective annular gas chamber while permitting some pressurized gas to be dissipated through its pores evenly around the circumference of the respective annular gas chamber.

18. A rotary drill bit in accordance with claim 17, wherein the porosity of each circumferential porous gas restrictor is in the range of 10% to 50%, with the gas passageways through the circumferential porous gas restrictor being small enough to prevent drilling debris from getting past the circumferential porous gas restrictor into the respective annular gas chamber.

19. A rotary drill bit in accordance with claim 17, wherein the metal particles are micro-beads.

20. A rotary drill bit in accordance with claim 6, wherein each circumferential porous gas restrictor is formed of metal particles fused together such that each circumferential porous gas restrictor is strong enough to withstand the stresses of operation of the drill bit while providing a porosity which is capable of maintaining the pressure of the gas in the respective annular gas chamber while permitting some pressurized gas to be dissipated through its pores evenly around the circumference of the respective annular gas chamber.

21. A rotary drill bit in accordance with claim 20, wherein the porosity of each circumferential porous gas restrictor is in the range of 10% to 50%, with the gas passageway through the circumferential porous gas restrictor being small enough to prevent drilling debris from getting past the circumferential porous gas restrictor into the respective annular gas chamber.

22. A rotary drill bit in accordance with claim 20, wherein the metal particles are micro-beads.

23. A rotary drill bit in accordance with claim 9, wherein each circumferential porous gas restrictor is formed of metal particles fused together such that each circumferential porous gas restrictor is strong enough to withstand the stresses of operation of the drill bit while providing a porosity which is capable of maintaining the pressure of the gas in the respective annular gas chamber while permitting some pressurized gas to be dissipated through its pores evenly around the circumference of the respective annular gas chamber.

24. A rotary drill bit in accordance with claim 23, wherein the porosity of each circumferential porous gas restrictor is in the range of 10% to 50%, with the gas passageways through the circumferential porous gas restrictor being small enough to prevent drilling debris from getting past the circumferential porous gas restrictor into the respective annular gas chamber.

25. A rotary drill bit in accordance with claim 23, wherein the metal particles are micro-beads.

26. A rotary drill bit in accordance with claim 12, wherein each circumferential porous gas restrictor is formed of metal particles fused together such that each circumferential porous gas restrictor is strong enough to withstand the stresses of operation of the drill bit while providing a porosity which is capable of maintaining the pressure of the gas in the respective annular gas chamber while permitting some pressurized gas to be dissipated through its pores evenly around the circumference of the respective annular gas chamber.

27. A rotary drill bit in accordance with claim 26, wherein the porosity of each circumferential porous gas restrictor is in the range of 10% to 50%, with the gas passageways through the circumferential porous gas restrictor being small enough to prevent drilling debris from getting past the circumferential porous gas restrictor into the respective annular gas chamber.

28. A rotary drill bit in accordance with claim 26, wherein the metal particles are micro-beads.

29. In a drill bit having a body with a plurality of cutting elements, each of the cutting elements comprising a leg member having a projecting, conical cutter receiving journal, a conical cutter having an axially extending recess open at one end, and friction reducing bearings interior to the cutting element for rotatably mounting the conical cutter on the journal in spaced relationship with the journal, the improvement comprising:

(a) each cutting element having an outer annular seal and an inner annular seal at the open end of the respective recess in coaxial relationship with each other with a circumferential seal gap between the two seals, each inner annular seal being designed to cause migration of lubricant from the bearings into the circumferential seal gap while preventing lubricant and contaminants from the circumferential seal gap from traveling past the inner annular seal to the bearings, each such outer annular seal having less resistance to the flow of lubricating fluid in the direction from the circumferential seal gap to the open end of the conical cutter than the resistance to the flow of lubricating fluid of each inner annular seal on its circumferential seal gap side, the lubricating fluid carried into the circumferential seal gap eventually exiting past the respective outer annular seal;

(b) each cutting element having a circumferential porous gas restrictor concentric with and exterior to the respective outer annular seal, the circumferential porous gas restrictor being spaced from the respective outer annular seal to form an annular gas chamber therebetween; and (c) each leg member having a gas passageway extending into the respective annular gas chamber to carry pressurized gas into the respective annular gas chamber, each circumferential porous gas restrictor being capable of maintaining the pressure of the gas in the respective annular gas chamber while permitting lubricant which has exited past the respective outer annular seal and some pressurized gas to be dissipated through its pores.

30. A rotary drill bit in accordance with claim 29, wherein each circumferential porous gas restrictor is formed of metal particles fused together such that each circumferential porous gas restrictor is strong enough to withstand the stresses of operation of the drill bit while providing a porosity which is capable of maintaining the pressure of the gas in the respective annular gas chamber while permitting some pressurized gas to be dissipated through its pores evenly around the circumference of the respective annular gas chamber.

31. A rotary drill bit in accordance with claim 30, wherein the porosity of each circumferential porous gas restrictor is in the range of 10% to 50%, with the gas passageways through the circumferential porous gas restrictor being small enough to prevent drilling debris from getting past the circumferential porous gas restrictor into the respective annular gas chamber.

32. A rotary drill bit in accordance with claim 30, wherein the metal particles are micro-beads.

* * * * *

UNITED STATES PATENT AND TRADEMARK OFFICE

CERTIFICATE OF CORRECTION

PATENT NO. : 4,981,182

DATED : January 1, 1991

INVENTOR(S) : Theodore R. Dysart

It is certified that error appears in the above-identified patent and that said Letters Patent is hereby corrected as shown below:

Column 2, line 5, change "hoe" to --hole--.
Column 12, line 19, change "rom" to --from--.
Column 12, line 29, change "disengaged" to --dissipated--.
Column 12, line 47, change "conical" to --coaxial--.
Column 13, line 8, change "the" to --be--.
Column 15, line 64, change "drill being" to --drill bit--.

Signed and Sealed this

Seventeenth Day of November, 1992

*Attest:*

DOUGLAS B. COMER

*Attesting Officer*

*Acting Commissioner of Patents and Trademarks*